US006478928B1

(12) United States Patent
Sbaschnigg et al.

(10) Patent No.: US 6,478,928 B1
(45) Date of Patent: Nov. 12, 2002

(54) PROCESS FOR DEWATERING A PULP WEB

(75) Inventors: Johann Sbaschnigg, Graz (AT); Edgar Brogyanyi, Graz-Stattegg (AT); Wilhelm Mausser, Graz (AT)

(73) Assignee: Andritz-Patentverwaltungs-Gesselschaft m.b.H., Graz (AT)

( * ) Notice: Subject to any disclaimer, the term of this patent is extended or adjusted under 35 U.S.C. 154(b) by 54 days.

(21) Appl. No.: 09/729,035

(22) Filed: Dec. 4, 2000

Related U.S. Application Data

(62) Division of application No. 09/195,462, filed on Nov. 18, 1998, now Pat. No. 6,197,160.

(30) Foreign Application Priority Data

Nov. 28, 1997 (AT) ..... A 2020/97

(51) Int. Cl.[7] ..... D21F 11/00
(52) U.S. Cl. ..... 162/203; 162/208; 162/210
(58) Field of Search ..... 162/202–207, 162/300–305, 208–210, 217, 342, 352, 354, 361, 363, 368

(56) References Cited

U.S. PATENT DOCUMENTS

| | | | | | |
|---|---|---|---|---|---|
| 5,045,153 | A | | 9/1991 | Sollinger et al. | 162/301 |
| 5,074,964 | A | | 12/1991 | Partanen | 162/203 |
| 5,167,770 | A | | 12/1992 | Bubik et al. | 162/301 |
| 5,185,064 | A | | 2/1993 | Nyman | 162/301 |
| 5,259,929 | A | | 11/1993 | Bubik et al. | 162/301 |
| 5,389,206 | A | * | 2/1995 | Bück et al. | 162/301 |
| 5,507,918 | A | | 4/1996 | Polifke et al. | 162/301 |
| 5,599,427 | A | * | 2/1997 | Koivuranta et al. | 162/301 |
| 5,690,791 | A | * | 11/1997 | Vallius | 162/205 |
| 5,736,011 | A | | 4/1998 | Kade et al. | 162/336 |
| 5,759,353 | A | | 6/1998 | Jaakkola et al. | 162/301 |
| 5,833,809 | A | * | 11/1998 | Odell | 162/203 |
| 5,853,544 | A | * | 12/1998 | Egelhof et al. | 162/203 |
| 5,914,009 | A | | 6/1999 | Kotitschke | 162/301 |
| 5,916,420 | A | * | 6/1999 | Wurster et al. | 162/137 |
| 5,935,382 | A | | 8/1999 | Huovila et al. | 162/123 |
| 5,972,168 | A | | 10/1999 | Egelhof et al. | 162/203 |
| 6,027,612 | A | * | 2/2000 | Begemann et al. | 162/208 |
| 6,309,511 | B1 | * | 10/2001 | Iwata et al. | 162/352 |

* cited by examiner

*Primary Examiner*—Jose Fortuna
(74) *Attorney, Agent, or Firm*—Alix, Yale & Ristas, LLP

(57) ABSTRACT

The invention refers to a process for dewatering a pulp web, particularly a chemical pulp web, where dewatering takes place between twin wire belts or felts in an initial dewatering zone with a set area pressure and then in a second dewatering zone. It is mainly characterized by the area pressure in the initial dewatering zone being pre-set, and in the second dewatering zone it is adjustable, with the web being dewatered in both directions (upwards and downwards). The invention also refers to a device for implementing the process.

7 Claims, 4 Drawing Sheets

PROCESS FOR DEWATERING A PULP WEB

This application is a divisional of Application No. 09/195,462 filed on Nov. 18, 1998 which issued on Mar. 6, 2001 as U.S. Pat. 6,197,160.

BACKGROUND OF THE INVENTION

The invention relates to a process for dewatering a pulp web, particularly a chemical pulp web, where dewatering takes place between twin wire belts or felts in an initial dewatering zone with a set area pressure and then in a second dewatering zone. The invention also refers to a device for carrying out the process.

On the one hand, Fourdrinier-type machines are known which can only dewater the web to a limited extent before it is fed to the press unit. As a result, the final dry content is relatively low. In addition, there are socalled twin wire presses which dewater material between two wires. In the machines built to date however, the course of the dewatering process could only be matched very roughly to the optimum dewatering curve, which meant that the optimum final dry content could not be achieved.

SUMMARY OF THE INVENTION

The aim of the invention is thus to create a process and a device which can achieve optimum dewatering at a high throughput without ruining the web.

According to the invention, this is achieved by the area pressure in the initial dewatering zone being pre-set, and in the second dewatering zone it is adjustable, with the web being dewatered in both directions (upwards and downwards). With this pre-set, initial dewatering zone and adjustable, second dewatering zone, the course of dewatering can be matched very well to the dewatering curve.

A favourable further development of the invention is characterised by the second dewatering zone being followed by a further dewatering zone, in which the pulp web to be dewatered is deflected several times. As a result, the course of dewatering can be matched even more effectively to the dewatering curve.

A favourable configuration of the invention is characterised by the pulp web being heated after the dewatering zones. This means that an even better dewatering effect can be achieved in the subsequent press unit.

A favourable further development of the invention is characterised by the pulp web being heated by hot water or, as an alternative, by steam.

An advantageous configuration of the invention is characterised by the pulp web being further dewatered by applying line pressure.

A favourable further development of the invention is characterised by the pulp web being further dewatered by vacuum.

The invention also refers to a device for dewatering a pulp web, particularly a chemical pulp web, where dewatering takes place in an initial dewatering zone with a set area pressure and in a second dewatering zone. It is characterised by the area pressure in the initial dewatering zone being pre-set, and then adjustable in the second dewatering zone, and by each dewatering zone containing a dewatering element to dewater upwards and one to dewater downwards.

A favourable further development of the invention is characterised by the first dewatering zone forming a wedge shape, which can also be pre-set.

An advantageous configuration of the invention is characterised by the dewatering elements in the wedge zone having perforated plates or, as an alternative, cross-ribs.

A favourable configuration of the invention is characterised by the second dewatering zone having a bottom dewatering box whose height can be adjusted and which preferably also has perforated plates or cross-ribs.

A favourable further development of the invention is characterised by the top dewatering element in the second dewatering stage being able to be pressed against the bottom dewatering box.

An advantageous further development of the invention is characterised by the dewatering elements in the third dewatering zone having cross-ribs, where these ribs can be placed in an offset arrangement to one another, causing the pulp web to be deflected several times.

A favourable configuration of the invention is characterised by a device being provided to heat the web, particularly a steam blow box.

A favourable further development of the invention is characterised by at least one press unit being provided to generate line pressure, whereby one roll in the press unit may be designed as a suction roll.

The course of the process will now be described in more detail in the following. A manifold with pipe distributor feeds pulp suspension at a consistency of, for example, approx. 1 to 1.5% in cross-machine direction to a headbox, where it is turned through 90° towards the machine direction, flows through an outlet chamber, and when it leaves this chamber, is applied to a wire section on which the pulp web immediately forms. This wire section comprises a bottom and a top wire. Various devices (dewatering elements) are integrated into this section to permit gentle dewatering of the pulp web. These are fixed dewatering elements mounted at the inlet to this section that form a wedge over a defined length, where the height of the wedge's inlet and outlet gap can be set to suit the output and thus, the web thickness. Here, basis weights are obtained between 600 and 1200 g/m$^2$ at web speeds of up to 200 m/min. These dewatering elements comprise supporting structures made of acid-resistant steel, as well as linings which can either take the form of perforated plates or of cross-ribs, made of plastic or ceramic material. The pulp is dewatered upwards and downwards, while the filtrate removed is extracted from the top boxes by vacuum and then runs through filtrate traps. At the end of this wedge the pulp web has a defined dry content in the range of approximately 12 to 14% DS.

Adjoining this section there is a further double-action (upward and downward) dewatering element. This comprises a bottom dewatering box whose height can be adjusted and which has either perforated plates or cross-ribs, made of plastic or ceramic material, as well a hinged top dewatering box, which is also fitted either with perforated plates or cross-ribs and which is pressed against the bottom box by air cylinders or bellows. The pressure during this process is set as high as possible without ruining the web. An adjustable mechanical limit stop prevents the top box from being lowered too far and thus, from possibly ruining the wires and/or the dewatering elements. Thanks to this pressure-loading device, the pulp web can be dewatered effectively, upwards and downwards, to an optimum along these dewatering elements, with the top box being designed as a vacuum box.

Attached by a hinge to this second dewatering element is a third dewatering element. The bottom part of this dewatering element is height-adjustable and fitted with ceramic cross-ribs. The top part can again be pressure-loaded by air spring elements and has the same mechanical limit stops as the second box. It preferably comprises three chambers, which can be emptied by means of a vacuum, and is fitted with ceramic cross-ribs, with the suction vacuum increasing from one chamber to the next and amounting, for example, to 1 m water column in the first chamber, 2 m water column in the second, and 3 m water column in the third. The cross-ribs in the top dewatering box are pushed into the gaps between the ribs in the bottom dewatering box and lead to the two wires with the pulp web in between being deflected to a greater or lesser extent (depending on the pressing force) between the ribs. This permits the settings of the boxes to be adjusted to achieve optimum dewatering of the pulp web.

The depth to which the top ribs are pushed in between the bottom ribs is approximately 20 mm at the end of the wedge, with a mechanical limit stop being provided to prevent any damage to the web.

After the third dewatering element, the top wire is separated from the bottom wire. In order to ensure that the pulp web remains on the bottom wire, a suction box is installed below the bottom wire at this point. Subsequently, the pulp web only rests on the bottom wire alone and runs through a heating section comprising either a hot water feed or a steam blow box above the pulp web and a suction box underneath the bottom wire. The hot water or steam is pressed through the pulp web and causes it to heat up, which leads in turn to better dewatering behaviour by the pulp web in the press section. A wire suction roll or blind press roll is positioned at the end of the bottom wire as the final dewatering element. At the wire suction roll, the remaining filtrate is sucked out of the web through holes in the roll shell by a vacuum applied inside the roll. In order to increase the dewatering effect even further, a press roll is mounted above the suction zone of this roll.

The advantage of this dewatering device is that, contrary to conventional Fourdrinier dewatering machines, the dewatering process takes place immediately after the pulp leaves the headbox, with the web being dewatered towards both sides and with well-aimed intensity thanks to the dewatering elements described above, without ruining the web structure, which is an important factor in the further drying process following the dewatering machine. Two-sided dewatering creates a substantial saving in the overall length of the machine (approximately ⅓ shorter than a Fourdrinier machine). The machine can be cantilevered, allowing the wires to be changed very quickly.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
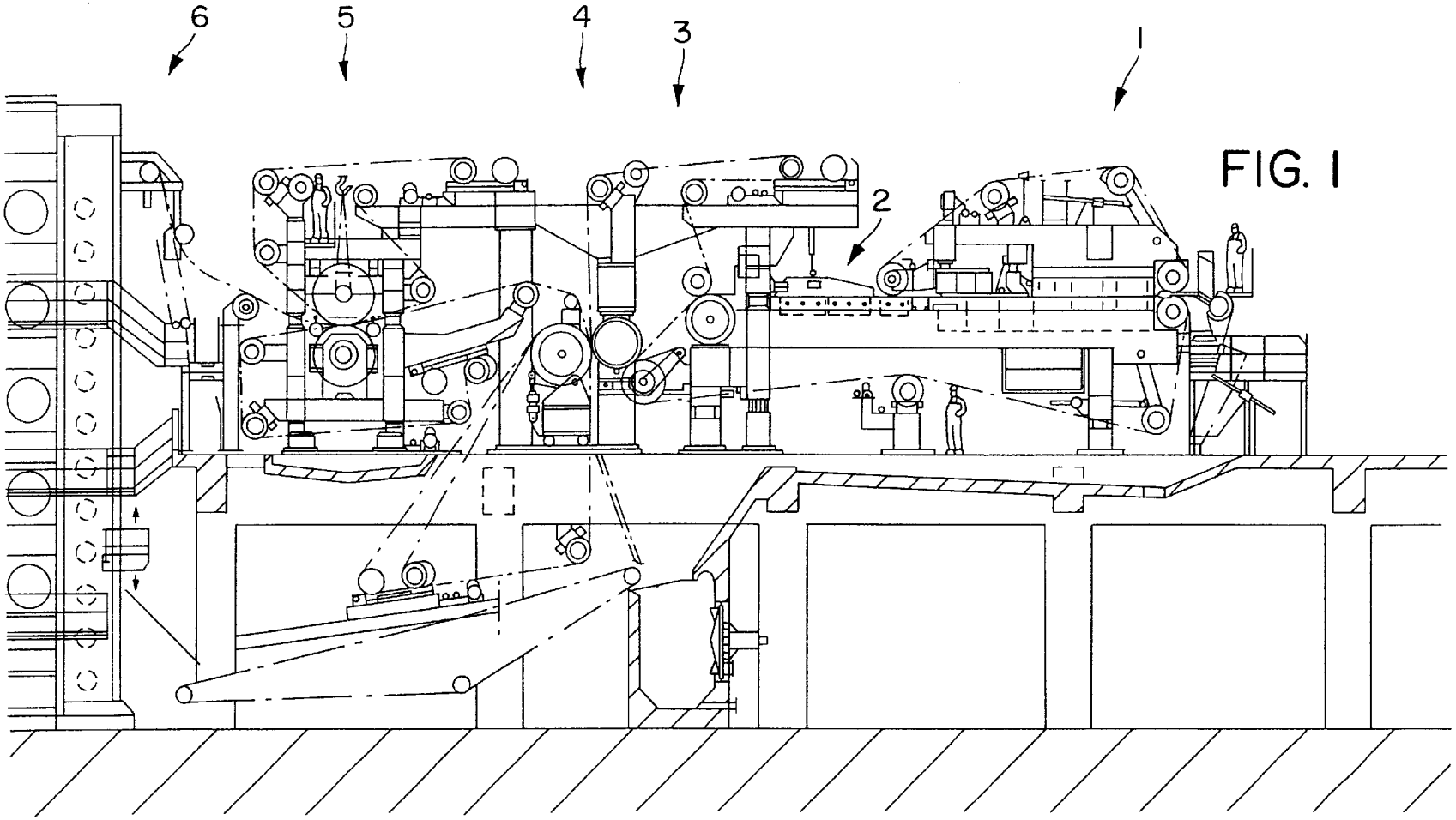
FIG. 1 is a schematic side view, partly in phantom and partly in cross-section, of a plant including a web dewatering apparatus in accordance with the invention.

FIG. 1 shows a plant for web drying with a dewatering device 1, a steam blow box 2, a first pressing unit 3, a further pressing unit 4, a heavy-duty press 5, followed by a dryer 6, which can be, for example, an airborne dryer.

Figure 2:
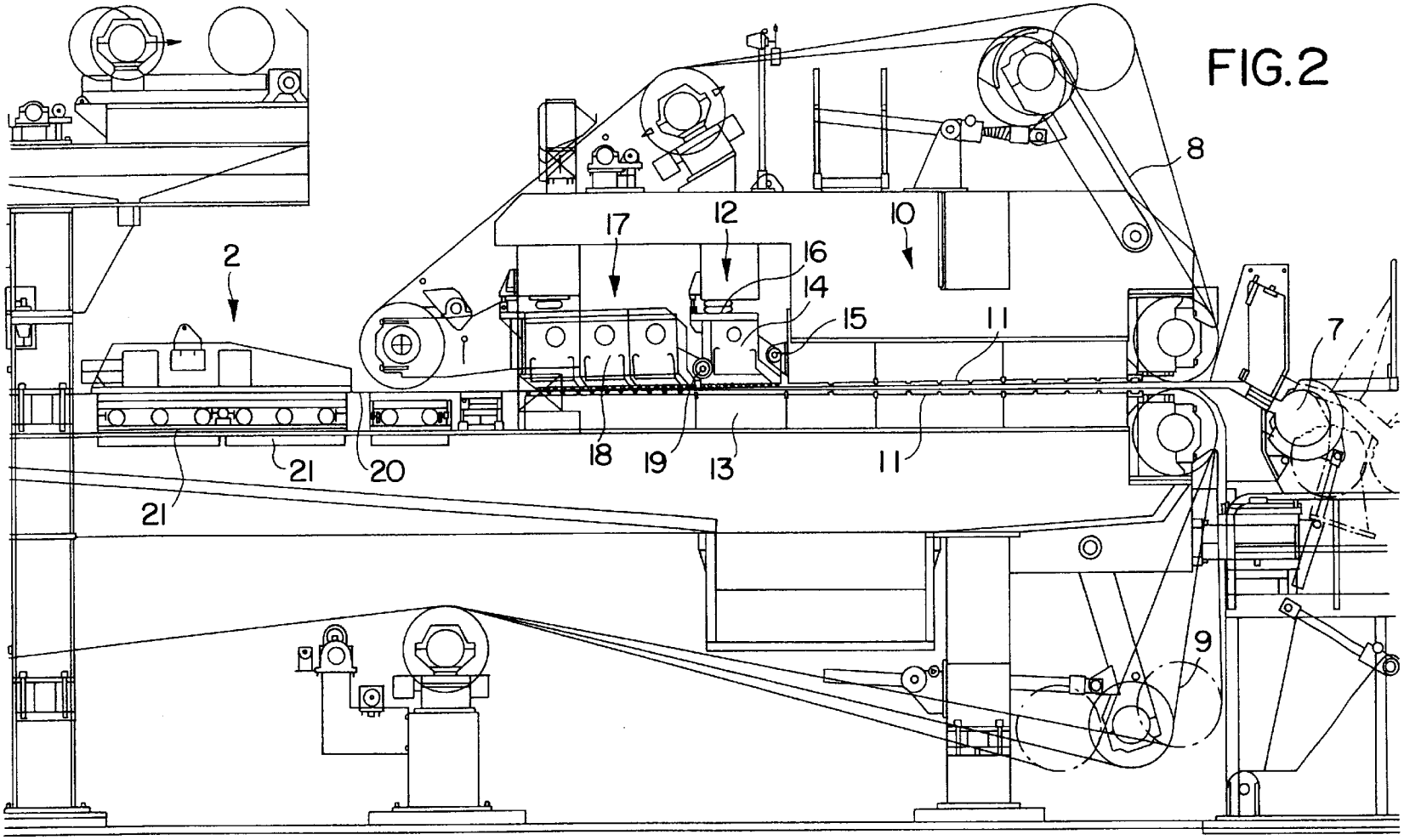
FIG. 2 is an enlarged schematic side view of the web dewatering apparatus and blow box of FIG. 1.

FIG. 2 now shows the dewatering device I in detail. The chemical pulp suspension is fed in here through nozzles via a headbox 7 between a top wire 8 and bottom wire 9, with the wires 8 and 9 converging in a wedge shape in the dewatering zone 10. The pulp web formed at the inlet is dewatered gently in this area. Dewatering elements used here are, for example, perforated plates 11, which support the appropriate wire both above and below. Here, dewatering is achieved in both directions, which ensures that the web is dewatered evenly. The dry content after the dewatering zone 10 is, for example, 12–14%. The adjoining dewatering zone 12 comprises a height-adjustable bottom box 13, and a top box 14, which is connected to the top box of the first dewatering stage 10 by a hinge 15. This top box 14 is pressed against the bottom box 13 by air cylinders or bellows 16. The top box 18 in the next dewatering zone 17 is connected to the top box 14 of the dewatering zone 12 by a hinge 19. Following the dewatering zone marked 17, the top wire 8 is returned to the inlet to the dewatering zone marked 10. By then applying hot water or a steam blow box 2, the pulp web is heated and the cooled water or condensate drains off into one (or more) suction boxes 21 underneath the web 20.

Figure 3:
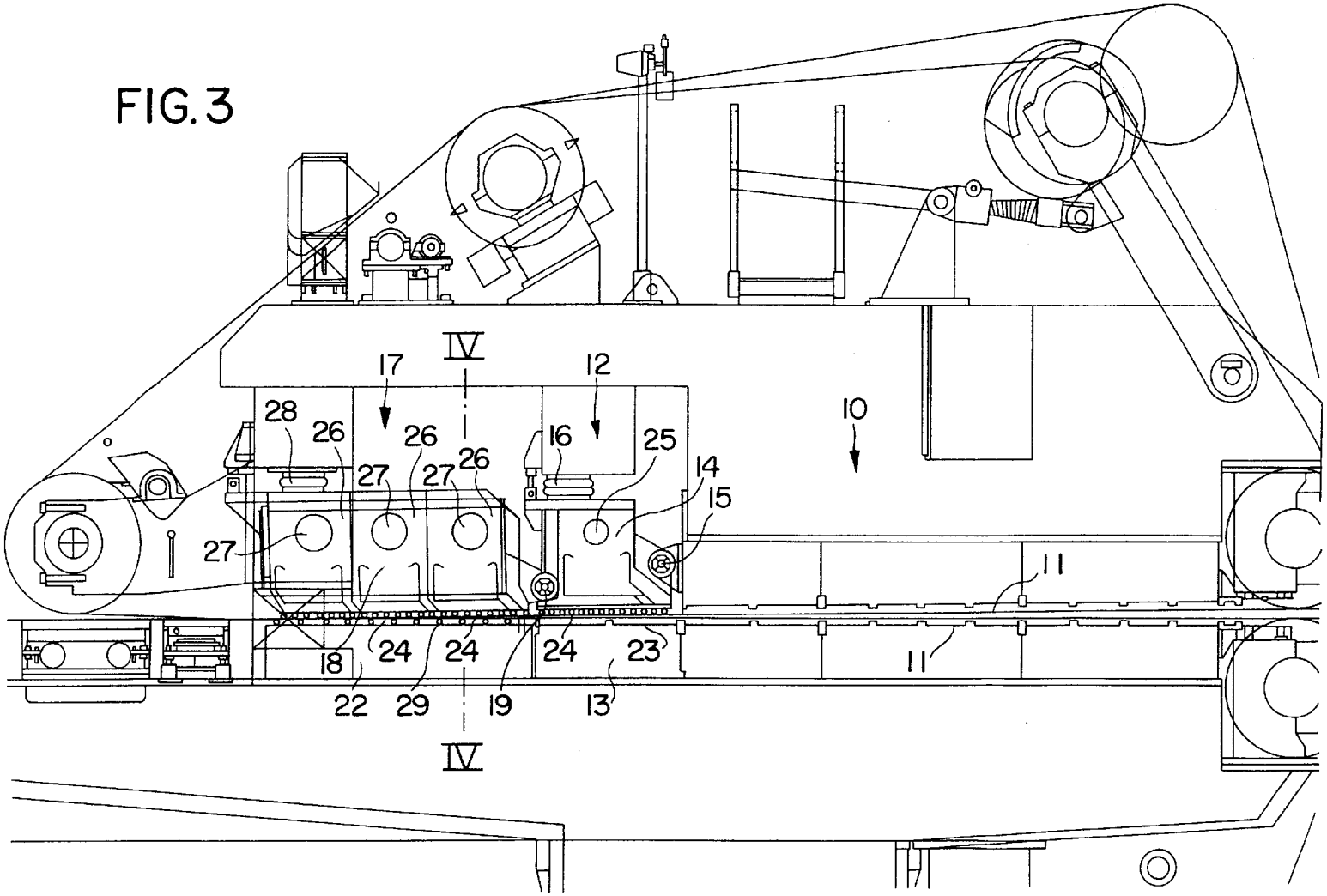
FIG. 3 is an enlarged schematic side view of the web dewatering apparatus of FIG. 1.

FIG. 3 shows the extract from the dewatering device 1 with dewatering zones 12 and 17. Here, the zone marked 12 has a bottom box 13 which is fitted with a perforated plate 23. As an alternative, however, cross-ribs could also be used. The top box 14 has ribs 24 running across the machine direction. Both these ribs and the perforated plates can be made either of plastic or ceramic material. In addition, the top box 14 has a connection point 25 for a vacuum unit. If the dewatering zone 12 is built with cross-ribs in the bottom box 13, this results in a large open area for draining off the water pressed out of the pulp.

Here, the top box 18 in the dewatering zone 17 has three chambers 26, to which a vacuum is applied through the connection pipe 27. This vacuum increases from the first chamber 26 viewed in web running direction to the last chamber, the usual vacua being 0.01 MPa, 0.02 MPa and 0.03 MPa for the individual chambers 26. The top box 18 is pressed against the bottom box 22 by an air bellow 28. When this happens, the ribs 24 running across the machine direction in the top box 18 are pushed in between the ribs 29 in the bottom box 22, causing deflection of the two wires 7 and 8 and of the pulp web 20 between them to a greater or lesser extent. This has a further dewatering effect. The depth to which the top ribs 24 are pushed between the bottom ribs 29 is approximately 20 mm at the end of the dewatering zone 17, with the pressing force applied by the air bellow 28 being selected at the maximum possible without causing damage to the web 20.

Figure 4:
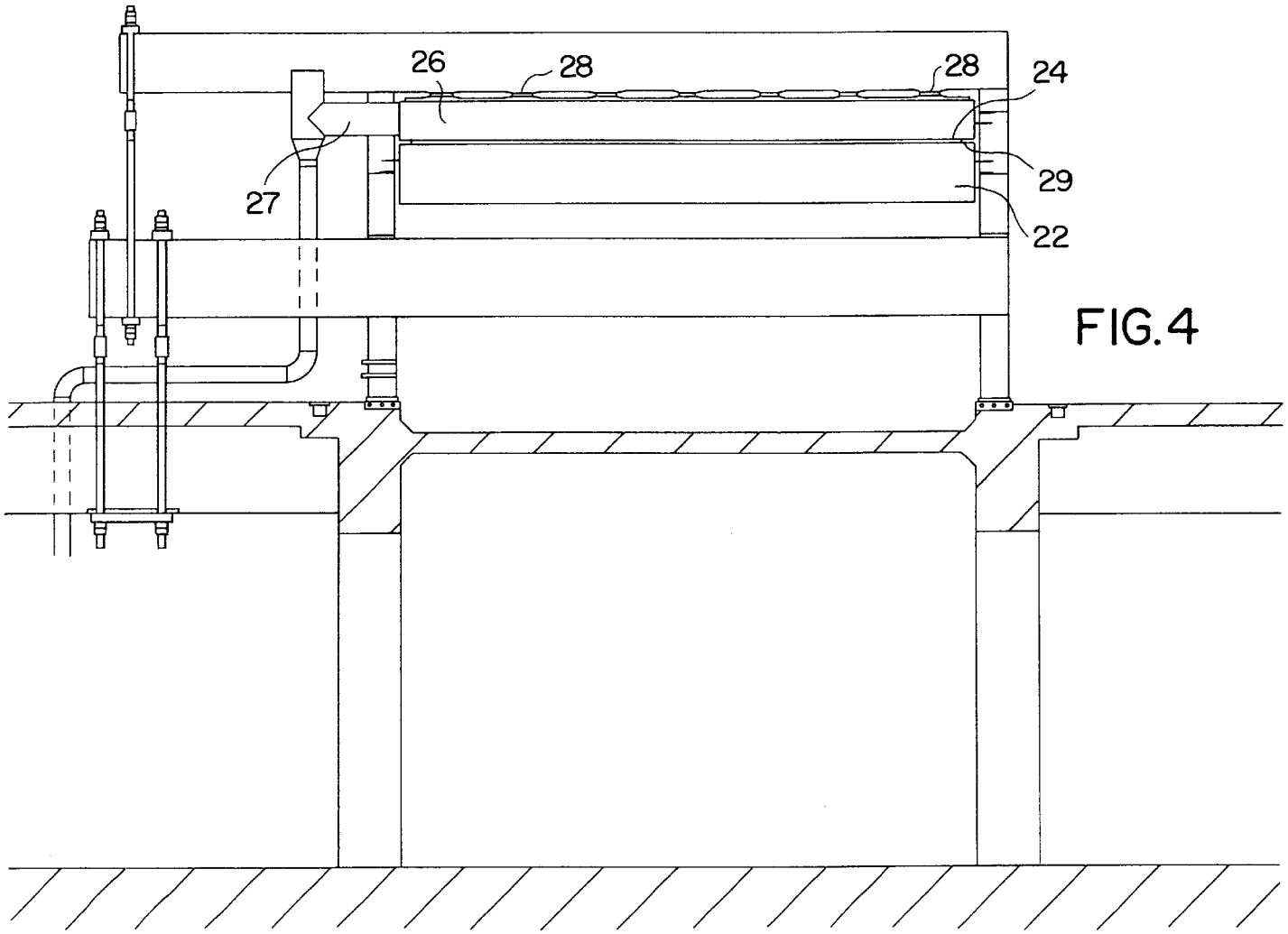
FIG. 4 is an enlarged cross-section view of the web dewatering device taken along line IV—IV of FIG. 3.

FIG. 4 shows a cross section through the line marked IV—IV in FIG. 3. This illustration shows the bottom box 22 with the bottom cross-ribs 29, as well as one chamber 26 of the top box 18 and the ribs 24 in this box.

While preferred embodiments have been shown and described, various modifications and substitutions may be made thereto without departing from the spirit and scope of the invention. According, it is to be understood that the present invention has been described by way of illustration and not limitation.

What is claimed is:

1. Process for dewatering a chemical pulp web between upper and lower wire substantially horizontal belts or felts comprising the steps of:

dewatering the web in an initial wedge-shaped dewatering zone having a pre-set area pressure which is increasing continuously; and dewatering the web in a second dewatering zone having an adjustable pressure;

wherein the web is dewatered in both an upward and a downward direction in all dewatering zones.

2. Process according to claim 1, further comprising the step of dewatering the web in a third zone in which the pulp web to be dewatered is deflected several times.

3. Process according to claim 1, further comprising the step of heating the pulp web after the dewatering zones.

4. Process according to claim 3, wherein the pulp web is heated by hot water.

5. Process according to claim 3, wherein the pulp web is heated by steam.

6. Process according to claim 1, wherein the pulp web is further dewatered by applying line pressure.

7. Process according to claim 1, further comprising the step of further dewatering the pulp web by vacuum.

* * * * *